US009493987B2

(12) United States Patent
Sihler

(10) Patent No.: US 9,493,987 B2
(45) Date of Patent: Nov. 15, 2016

(54) COIL TUBING ORIENTER TOOL WITH DIFFERENTIAL LEAD SCREW DRIVE

(71) Applicant: Schlumberger Technology Corporation, Sugar land, TX (US)

(72) Inventor: Joachim Sihler, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 132 days.

(21) Appl. No.: 14/306,207

(22) Filed: Jun. 16, 2014

(65) Prior Publication Data

US 2014/0299381 A1 Oct. 9, 2014

Related U.S. Application Data

(62) Division of application No. 12/974,055, filed on Dec. 21, 2010, now Pat. No. 8,789,589.

(60) Provisional application No. 61/288,487, filed on Dec. 21, 2009.

(51) Int. Cl.
*E21B 7/04* (2006.01)
*E21B 7/06* (2006.01)

(52) U.S. Cl.
CPC ..... *E21B 7/04* (2013.01); *E21B 7/067* (2013.01); *Y10T 74/18576* (2015.01)

(58) Field of Classification Search
CPC .... E21B 23/00; E21B 2023/008; E21B 7/06; E21B 7/062; E21B 7/068; E21B 7/067; F16H 25/2006; F16H 25/2056; F16H 1/08; F16H 2025/2028; F16H 2025/2081; H02K 7/06; B23Q 5/402
See application file for complete search history.

(56) References Cited

U.S. PATENT DOCUMENTS

| | | | | |
|---|---|---|---|---|
| 1,785,086 | A * | 12/1930 | Hauk | E21B 17/073 175/232 |
| 3,703,104 | A * | 11/1972 | Tamplen | E21B 23/006 166/240 |
| 4,007,797 | A * | 2/1977 | Jeter | E21B 4/00 173/149 |
| 5,535,823 | A * | 7/1996 | Reid | E21B 23/00 166/123 |
| 5,555,946 | A * | 9/1996 | Klatt | E21B 7/061 166/216 |
| 5,775,444 | A * | 7/1998 | Falgout, Sr. | E21B 23/04 175/322 |
| 6,082,453 | A * | 7/2000 | Bakke | E21B 23/006 166/240 |
| 6,253,632 | B1 * | 7/2001 | Poulek | E06B 9/72 74/89.23 |
| 6,345,669 | B1 * | 2/2002 | Buyers | E21B 23/14 166/381 |
| 2004/0129457 | A1 * | 7/2004 | McNeilly | E21B 17/073 175/57 |
| 2005/0139357 | A1 * | 6/2005 | Martin | E21B 23/00 166/301 |
| 2005/0236189 | A1 * | 10/2005 | Rankin | E21B 4/006 175/73 |
| 2010/0000794 | A1 * | 1/2010 | Hall | E21B 7/067 175/61 |
| 2011/0253453 | A1 | 10/2011 | Sihler | |

* cited by examiner

*Primary Examiner* — Kipp Wallace

(57) ABSTRACT

A technique facilitates control over the orientation of a bottom hole assembly. The bottom hole assembly comprises an orienting tool having a dual-spline drive which, in turn, comprises a first lead screw portion and a second lead screw portion having threads of a first pitch and a second pitch, respectively. A motor is connected to the dual-spline drive to impart rotational motion with respect to the first threads having the first pitch. A difference in pitch between the first pitch and the second pitch enables the rotational motion imparted by the motor to be converted to a slower, higher torque, output via the second lead screw portion. As a result, the orienting tool is able to provide a selective, high torque, low-speed adjustment to the drilling orientation of the bottom hole assembly.

11 Claims, 2 Drawing Sheets

COIL TUBING ORIENTER TOOL WITH DIFFERENTIAL LEAD SCREW DRIVE

This is a divisional application of co-pending U.S. patent application Ser. No. 12/974,055, filed on Dec. 21, 2010 which claims priority of U.S. Provisional Patent Application Ser. No. 61/288,487, filed on Dec. 21, 2009, and entitled "Coil Tubing Orienter Tool with Differential Lead Screw Drive," which is hereby incorporated in their entirety for all intents and purposes by these references.

BACKGROUND OF THE DISCLOSURE

Field of the Disclosure

The subject disclosure relates generally to oilfield drilling, and more particularly to bottom hole assemblies and tools for orienting a bottom hole assembly (BHA).

Background of the Related Art

In conventional drilling, the BHA is lowered into the wellbore using jointed drill pipes or coiled tubing. Often the BHA includes a mud motor, directional drilling and measuring equipment, measurements-while-drilling tools, logging-while-drilling tools and other specialized devices. A simple BHA having a drill bit, various crossovers, and drill collars is relatively inexpensive, costing a few hundred thousand US dollars, while a complex BHA costs ten times or more than that amount.

Many drilling operations require directional control so as to position the well along a particular trajectory into a formation. Directional control, also referred to as "directional drilling," is accomplished using special BHA configurations, instruments to measure the path of the wellbore in three-dimensional space, data links to communicate measurements taken downhole to the surface, mud motors, and special BHA components and drill bits. The directional driller can use drilling parameters such as weight-on-bit and rotary speed to deflect the bit away from the axis of the existing wellbore. In some cases, e.g. when drilling into steeply dipping formations or when experiencing an unpredictable deviation in conventional drilling operations, directional-drilling techniques may be employed to ensure that the hole is drilled vertically.

Direction control is most commonly accomplished through the use of a bend near the bit in a downhole steerable mud motor. The bend points the bit in a direction different from the axis of the wellbore when the entire drill string is not rotating. By pumping mud through the mud motor the bit rotates (though the drill string itself does not), allowing the bit alone to drill in the direction to which it points. When a particular wellbore direction is achieved, the new direction may be maintained by then rotating the entire drill string, including the bent section, so that the drill bit does not drill in a direction away from the intended wellbore axis, but instead sweeps around, bringing its direction in line with the existing wellbore. As it is well known by those skilled in the art, a drill bit has a tendency to stray from its intended drilling direction, a phenomenon known as "drill bit walk". A device for addressing drill bit walk is shown in U.S. Pat. No. 7,610,970 to Sihler et al. issued Nov. 3, 2009, which is incorporated herein by reference.

The use of coiled tubing with downhole mud motors to turn the drill bit to deepen a wellbore is another form of drilling, one which proceeds quickly compared to using a jointed pipe drilling rig. By using coiled tubing, the connection time required with rotary drilling is eliminated.

Coiled tube drilling is economical in several applications, such as drilling narrow wells, working in areas where a small rig footprint is essential, or when reentering wells for work-over operations.

In coiled tubing drilling, a BHA with a mud motor is attached to the end of a coiled tubing string. Typically, the mud motor has a fixed or adjustable bend housing to drill deviated holes. Because the coiled tubing is unable to rotate from surface, a so called orienter tool is used as part of the BHA to "orient" the bend of the mud motor into the desired direction. There exists a multitude of different designs for the drive systems of such tools. Some designs support continuous rotation such as electric motor and gearbox drives, while others only permit rotation by a certain limited angle.

BRIEF DESCRIPTION OF THE DRAWINGS

So that those having ordinary skill in the art to which the disclosed system appertains will more readily understand how to make and use the same, reference may be had to the following drawings.

DETAILED DESCRIPTION OF PREFERRED EMBODIMENTS

Figure 1A:
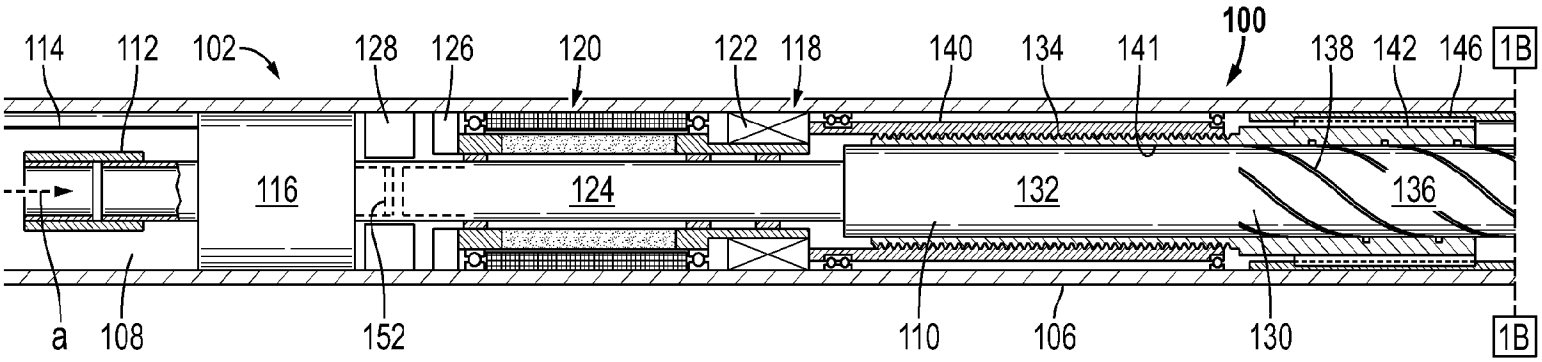
FIG. 1A is a cross-sectional view of a distal portion of a bottom hole assembly with an orienter tool in accordance with the subject technology.

The present disclosure overcomes many of the prior art problems associated with directing or orienting a bottom hole assembly in coiled tubing applications. The advantages, and other features of the orienting tool disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

All relative descriptions herein such as left, right, up, and down are with reference to the Figures, and not meant in a limiting sense. Unless otherwise specified, the illustrated embodiments can be understood as providing exemplary features of varying detail of certain embodiments, and therefore, unless otherwise specified, features, components, modules, elements, and/or aspects of the illustrations can be otherwise combined, interconnected, sequenced, separated, interchanged, positioned, and/or rearranged without materially departing from the disclosed systems or methods. Additionally, the shapes and sizes of components are also exemplary and unless otherwise specified, can be altered without materially affecting or limiting the disclosed technology.

The subject technology is directed to a mechanical, coiled tubing orienter tool. The orienting rotation is accomplished by using a dual-spline drive, where the driving spline uses a relatively small pitch, and the driven spline uses a relatively large pitch. The difference in pitch provides a means of mechanical power transmission to convert high speed/low torque (e.g. typical for an electric motor) into a low-speed/high torque output. The orienter also can be wired, either by adding a slip-ring type electrical connector box or by stretching a wire from top to bottom inside the flow bore if the rotation is non-continuous.

Another embodiment of the present invention includes an orienter tool for a bottom hole assembly (BHA) having an output shaft used in selecting drilling direction. The orienter tool includes an elongated housing defining an interior. A dual-spline drive mounts within the interior. The dual-spline drive includes a first lead screw portion with first threads having a first pitch, a second lead screw portion with second threads having a second pitch, the second pitch being different from the first pitch, a lead screw drive nut held axially fixed about the first lead screw portion and rotationally free within the interior of the housing, and a driving bushing free to move axially along the second lead screw portion which is connected to the output shaft. A motor is connected to the dual-spline drive for rotation thereof. A straight spine mounts about the drive bushing and constrains rotation thereof. When the lead screw nut is rotated, the drive bushing is pushed axially proximally or distally depending upon a direction of rotation and, in turn, the drive bushing imposes a rotation upon the output shaft.

In this embodiment, the second pitch is relatively larger than the first pitch. The difference in rotational angle or speed between the lead screw drive nut and the output shaft is equal to a mechanical transmission ratio of the orienter tool. The orienter tool also may include a gear box connected between the motor and the lead screw drive nut, wherein the gear box is substantially not back-drivable, and/or a slip ring connector box for wiring the BHA in an annular fashion in conjunction with a through-bore defined in the interior.

In another embodiment, the driving bushing has a portion of free twisting length. In one embodiment, a twisting stiffness of the portion of the free twisting length of the driving bushing approximately matches a twisting stiffness of the output shaft.

The present technology also is directed to a method for orienting a bottom hole assembly having an output shaft and an elongated housing defining an interior. The method comprises mounting a dual-spline drive within the interior. The dual-spline drive includes a first lead screw portion with first threads of a first pitch and a second lead screw portion with second threads of a second pitch, the second pitch being different from the first pitch. The method also comprises axially fixing a lead screw drive nut held about the first lead screw for engagement with the first threads, wherein the lead screw drive nut is rotatable within the interior of the housing and driven by motor. The method may further comprise mounting a drive bushing which is free to move axially along the second lead screw for engagement with the second threads, and connecting the second lead screw to the output shaft. The method also may comprise mounting a straight spline about the drive bushing within the interior to constrain rotation thereof, and rotating the dual-spline drive such that as the lead screw drive nut is rotated, the drive bushing is pushed axially proximally/distally depending upon a direction of rotation. In turn, the drive bushing imposes a rotation upon the output shaft.

It should be appreciated that the present technology can be implemented and utilized in numerous ways, including without limitation as a process, an apparatus, a system, a device, a method for applications now known and later developed. These and other unique features of the system disclosed herein will become more readily apparent from the following description and the accompanying drawings.

In brief overview, the subject technology is directed to a mechanical coiled tubing orienter tool and methods for using the same. The orienting rotation of the BHA is accomplished by using a dual-spline drive in which a first lead screw drive nut is held axially fixed and rotationally free inside the orienter housing. The dual-spline drive is powered by an electric motor and an optional gearbox. When this lead screw drive nut is rotated, the drive bushing is pushed axially down or up, depending on lead screw direction. The drive bushing is constrained against rotation by, for example, a straight spine. When the drive bushing is pushed axially, the drive bushing imposes a rotation of the output shaft by way of a second lead screw drive with a relatively large pitch. The difference in rotational angle or speed between the lead screw drive nut and the output shaft is equal to the inherent mechanical transmission ratio of the design.

Figure 1B:
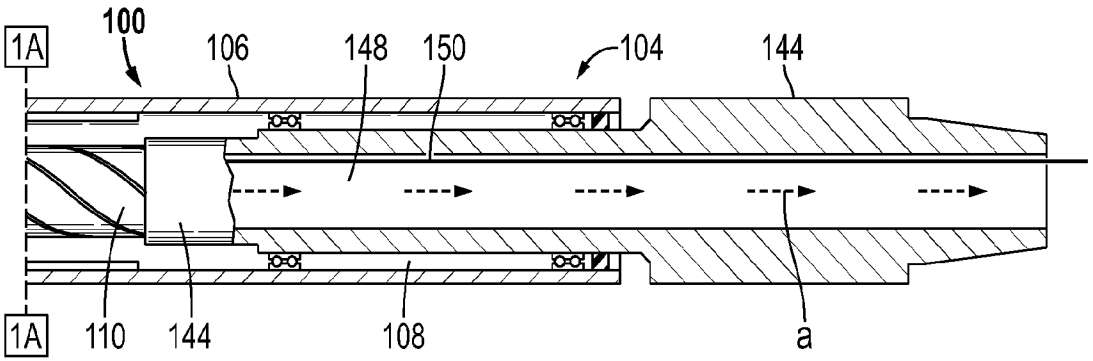
FIG. 1B is a cross-sectional view of a proximal portion of a bottom hole assembly with the orienter tool in accordance with the subject technology.

Referring generally to FIGS. 1A and 1B, cross-sectional views of a distal portion 102 and a proximal portion 104, respectively, of a bottom hole assembly (BHA) 100 are illustrated as having an orienter tool 110 in accordance with the subject technology. Matching lines 1A and 1B illustrate how to properly connect the distal portion 102 and the proximal portion 104 of FIGS. 1A and 1B, respectively, to form a continuous cross-sectional view.

The BHA 100 comprises coiled tubing or an elongated housing 106 that forms an interior 108 containing the orienter tool 110 and other components. The BHA 100 comprises a fluid swivel device 112 through which the drilling mud and/or water passes centrally. An electric wire 114 passes to an electrical connector box 116 for passing power and for exchanging signals with the BHA 100.

In the example illustrated, the orienter tool 110 comprises a dual-spline drive 118 powered by an electric motor 120 and an optional gearbox 122 mounted about a shaft/tube 124. The positions of the electric motor 120 and shaft 124 are monitored by sensors, such as a motor encoder 126 and a shaft encoder 128, respectively. In the embodiment illustrated, the motor 120 is connected to the gearbox 122 to operate a dual-spline 130. A first lead screw drive portion 132 of the dual-spline 130 has first threads 134 having a first pitch. A second lead screw drive portion 136 has second threads 138 having a second pitch which is different from the first pitch. In the embodiment shown, the second threads 138 have a relatively larger pitch than the first threads 134, e.g. 2-100 times larger, 100-1000 times larger, or more than 1000 times larger.

As illustrated, a lead screw drive nut 140 is mounted axially fixed about an axially movable portion 141 of the first lead screw drive portion 132 to engage the first threads 134 on movable portion 141. The lead screw drive nut 140 is rotatable within the interior 108 of the housing 106 via motor 120 and gear box 122 to selectively move portion 141 in an axial direction. A driving bushing 142 is engaged by movable portion 141 and is free to move axially along the second lead screw drive portion 136 while engaging the second threads 138. The driving bushing 142 connects to an output drive shaft 144 of the BHA 100 via the second lead screw drive portion 136. A straight spline 146 mounts about the drive bushing 142 to constrain rotation thereof. The output drive shaft 144 defines a fluid bore 148 also for carrying drilling mud flow as shown by the arrows "a". An electrical cable 150 may be positioned in the fluid bore 148 for passing signals, power and the like.

In the case of a slip-ring type connector box configuration, an appropriately shielded wire or electrical cable 150 may be stretched through the fluid bore 148 without the use of electrical connector box 116. As a result, the electrical cable may cope with a smaller twisting angle of the orienter tool 110 e.g. an angle of +/−200 degrees. In some embodiments, a slip-ring type connector box 152 (shown partially in dashed lines) may be used when, for example, the orienter tool is constructed in an annular fashion so that a continuous through-bore may be provided through large portions or through the entire length of the orienter tool 110.

In the embodiment illustrated, the orienting rotation of the BHA 100 is accomplished by using the dual-spline drive 118. When the lead screw drive nut 140 is rotated via motor 120 working in cooperation with gear box 122 (in this embodiment), the drive bushing 142 is pushed axially down or up (depending on the direction of the lead screw rotation) via axial movement of movable portion 141. The drive bushing 142 may be constrained against rotation by straight splines 146. When the drive bushing 142 is pushed axially, the drive bushing 142 imposes a rotation of the output drive shaft 144 by way of the second lead screw portion 136. A difference in rotational angle or speed between the lead screw drive nut 140 and the output drive shaft 144 occurs because of the difference in pitch of the threads 134, 138 on the lead screw drive portions 132, 136, respectively. The difference in rotational angle is equal to the inherent mechanical transmission ratio of the dual-spline design.

For example, if the first lead screw drive portion 132 has a pitch of 0.5 mm and the second lead screw drive portion 136 has a pitch of 0.5 m, a mechanical transmission ratio of 1000:1 is accomplished. To further manipulate the mechanical transmission, the gear box 122 between the electric motor 120 and the lead screw drive nut 140 may be employed. As an additional benefit, if the gear box 122 is not back-drivable, the BHA 100 does not require a separate brake.

Figure 2:
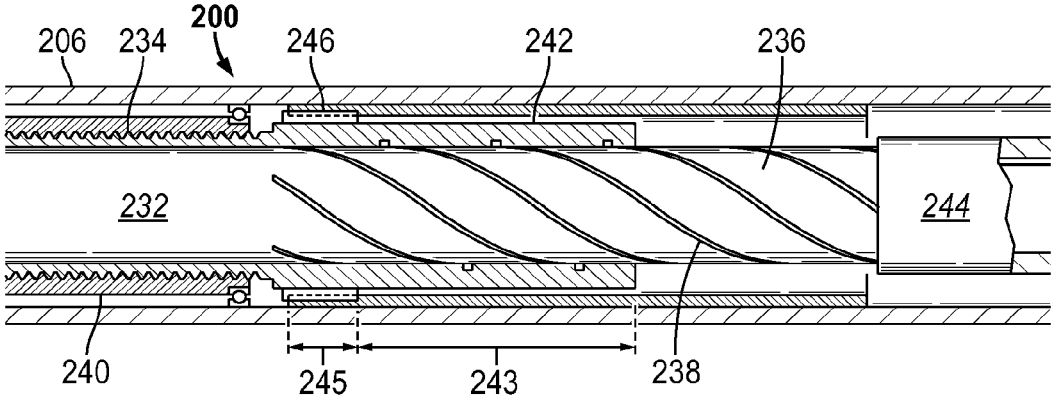
FIG. 2 is a partial cross-sectional view of another embodiment of an orienter tool in accordance with the subject technology.

Referring generally to FIG. 2, a partial cross sectional view of another embodiment of a BHA 200 in accordance with the subject technology is illustrated. As will be appreciated by those of ordinary skill in the pertinent art, the BHA 200 utilizes similar principles to the BHA 100 described above. Accordingly, like reference numerals preceded by the numeral "2" instead of the numeral "1" are used to indicate like elements. The primary difference of the BHA 200 in comparison to the BHA 100 is use of elastic averaging to even out forces imposed on the BHA 200.

When a large torque is exerted on a tubular structure, the result is elastic deformation in the form of twisting. Such twisting can result in uneven engagement and thus uneven contact forces in areas such as the distal region of the second lead screw drive portion 236. Furthermore, uneven engagement forces can lead to uneven and increased wear which sometimes results in component failure.

To cope with uneven engagement forces, drive bushing 242 utilizes a first portion 243 of free "twisting" length where the drive bushing 242 is not engaged with the straight spline 246. The drive bushing 242 also utilizes a second portion 245 which is engaged with the straight spline 246. The twisting stiffness of the free twisting length 243 of the drive bushing 242 may be selected to match the twisting stiffness of the drive shaft 244. As a result, even engagement of the lead screw drive portion 236 is accomplished by way of such elastic averaging.

Figure 3:
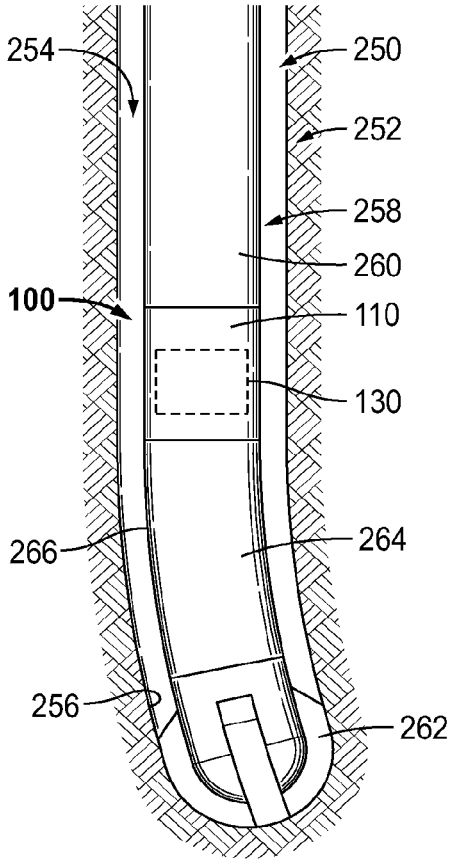
FIG. 3 is a schematic illustration of a drilling system having a bottom hole assembly utilizing an embodiment of the orienter tool.

Referring generally to FIG. 3, an example of a well system 250 is illustrated as deployed in a well 252 defined by at least one wellbore 254 having at least one deviated wellbore section 256 being formed. Although the orienter tool 110 of bottom hole assembly 100 may be utilized in a variety of downhole systems to provide improved control over the orienting of a variety of components, a well drilling example is illustrated in FIG. 3. In this example, the well system 250 includes a drilling system 258 comprising bottom hole assembly 100 delivered downhole by a suitable conveyance 260, such as coiled tubing.

In the embodiment illustrated, bottom hole assembly 100 includes the orienter tool 110 containing the dual-spline system 130. The orienter tool 110 and its dual-spline system 130 may be used to ultimately control the drilling orientation of a drill bit 262. In some drilling operations, the drill bit 262 is powered by a motor 264, such as a mud motor. Depending on the application, the mud motor 264 may work in cooperation with a bent housing 266 and the orienter tool 110 to control the desired direction of drilling. As known to those of ordinary skill in the art, bottom hole assembly 100 may comprise a variety of other components, including steering components, valve components, sensor components, measurement components, drill collars, crossovers, and/or other components. The actual selection of components depends on, for example, the specifics of the drilling application and/or the characteristics of the environment.

As would be appreciated by those of ordinary skill in the pertinent art, the subject technology is applicable to use in a variety of applications with significant advantages for bottom hole assembly applications. The functions of several elements may, in alternative embodiments, be carried out by fewer elements, or a single element. Similarly, in some embodiments, any functional element may perform fewer, or different, operations than those described with respect to the illustrated embodiment. Also, functional elements shown as distinct for purposes of illustration may be incorporated within other functional elements, separated in different hardware or distributed in various ways in a particular implementation. Further, relative size and location are merely somewhat schematic and it is understood that not only the same but many other embodiments could have varying depictions.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method for orienting a bottom hole assembly (BHA), the method comprising:

mounting a dual-spline drive within the interior of an elongated housing of an orienter tool, the dual-spline drive including a first lead screw portion with first threads of a first pitch and a second lead screw portion with second threads of a second pitch, the second pitch being different from the first pitch;

axially fixing a lead screw drive nut held about the first lead screw portion for engagement with the first threads, wherein the lead screw drive nut may be rotated within the interior of the housing;

mounting a drive bushing for movement axially along the second lead screw portion while engaged with the second threads;

connecting the second lead screw portion to an output shaft;

constraining rotation of the drive bushing; and rotating the lead screw drive nut to force axial movement of a movable member of the first lead screw portion against the drive bushing so as to force rotation of the second lead screw portion, thus imposing a rotation upon the output shaft.

2. The method as recited in claim 1, wherein the second pitch is relatively larger than the first pitch.

3. The method as recited in claim 1, wherein a difference in rotational angle or speed between the lead screw drive nut and the output shaft is equal to a mechanical transmission ratio of the orienter tool.

4. The method as recited in claim 1, further comprising wiring the BHA with a slip-ring type connector box.

5. The method as recited in claim 1, further comprising stretching a shielded wire through an orienter flow bore for providing power to the BHA.

6. The method as recited in claim 1, further comprising routing a shielded wire within the interior and providing the shielded wire with a twisting angle of approximately +/−200 degrees.

7. The method as recited in claim 1, wherein the drive bushing has a portion of free twisting length.

8. The method as recited in claim 7, further comprising establishing elastic averaging by approximately matching the twisting stiffness of the free twisting length of the drive bushing with a twisting stiffness of the output shaft.

9. A method of controlling a drilling direction when drilling a wellbore, comprising:

providing a bottom hole assembly with an orienting tool to control a drilling direction;

employing a dual-spline drive in the orienting tool;

adjusting the orientation of the orienting tool by rotating a first lead screw portion of the dual-spline drive to force rotation of a second lead screw portion of the dual-spline drive; and lowering the rotational speed and increasing the torque output of the second lead screw portion relative to the first lead screw portion by providing the second lead screw portion with drive threads having a substantially larger pitch than drive threads of the first lead screw portion.

10. The method as recited in claim 9, further comprising forcing rotation of the second lead screw portion by forcing axial movement of a drive bushing along the drive threads of the second lead screw portion.

11. The method as recited in claim 10, further comprising forcing the axial movement of the drive bushing with an axially movable member of the first lead screw portion.

* * * * *